United States Patent [19]

Adley et al.

[11] Patent Number: 4,616,919

[45] Date of Patent: Oct. 14, 1986

[54] NON-CONTACT DEVELOPER SEAL

[75] Inventors: James M. Adley, Longmont; Phillip Chang, Boulder, both of Colo.

[73] Assignee: International Business Machines Corporation, Armonk, N.Y.

[21] Appl. No.: 772,806

[22] Filed: Sep. 5, 1985

[51] Int. Cl.[4] ..... G03G 15/08

[52] U.S. Cl. ..... 355/3 DD; 355/3 R; 355/3 DR; 355/14 D; 355/15; 118/653; 430/120

[58] Field of Search ..... 355/3 DR, 3 R, 3 DD, 355/14 D, 15; 118/654, 655, 656; 430/120

[56] References Cited

U.S. PATENT DOCUMENTS

| | | | |
|---|---|---|---|
| 3,336,904 | 8/1967 | Obuchi | 118/654 X |
| 3,552,848 | 1/1971 | Van Wagner | 355/3 DR |
| 3,635,196 | 1/1972 | Tsilibes | 118/654 X |
| 3,647,293 | 3/1972 | Queener | 355/15 |
| 3,830,646 | 8/1974 | Chen | 355/3 DR |
| 4,213,617 | 7/1980 | Salger | 355/3 DD X |
| 4,258,372 | 3/1981 | Ishikawa | 346/153.1 |
| 4,292,922 | 10/1981 | Yamazaki et al. | 118/657 |
| 4,304,192 | 12/1981 | Mayer | 118/656 X |
| 4,361,396 | 11/1982 | Uchida | 355/15 |
| 4,370,051 | 1/1983 | Matsuyama et al. | 355/3 R |
| 4,575,217 | 3/1986 | Bothner | 355/3 DD |

*Primary Examiner*—A. C. Prescott

*Attorney, Agent, or Firm*—Marilyn D. Smith; Barbara A. McDowell; C. E. Rohrer

[57] ABSTRACT

A sealing apparatus in a magnetic brush development device is located in a non-contact fashion between the photoconductor drum and the magnetic brush roll. The seal has a plurality of ridges along the length of the seal that creates a differential air flow under the rotating photoconductor drum. This differential air flow prevents toner dust and bead carryout from axially migrating past the end of the photoconductor and magnetic roll.

9 Claims, 6 Drawing Figures

NON-CONTACT DEVELOPER SEAL

FIELD OF THE INVENTION

This invention relates to coating processes and more particularly to a process having magnetizable particles under the influence of a magnetic field, and wherein the magnet has a moving surface near it which carries the coating material, as in an electrophotographic process.

BACKGROUND ART

In machines utilizing the electrophotographic process, as in copier machines, there is usually a magnetic roll that attracts magnetizable particles called beads. These beads attract toner particles which become known as the carrier mix. As the carrier mix is magnetically attracted to the magnetic roll, which is essentially a cylinder with magnets inside, the surface of an electrostatically charged photoconductor passes in close proximity to the surface of the magnetic roll. Utilizing the principles of electrostatics and electrophotography, the toner on the magnetic roll is transferred to the photoconductor in a predetermined pattern which corresponds to the image pattern of the original to be copied or reproduced. The toner that is not adhered to the photoconductor during the image transfer ideally returns to the developer sump containing the carrier mix to await attraction to the magnetic roll.

As a practical result, however, the toner dust and beads have a tendency to migrate to undesired areas throughout the electrophotographic development device. Although this migration occurs in any type of copier development device, it is especially evident in a two cycle copier development process.

A typical two cycle process is described in U.S. Pat. No. 3,647,293 to Queener, and assigned to the same assignee as this application. As in any process, either one or two cycles, the two cycle process has the usual facilities for charging, imaging, developing, cleaning, transferring, precleaning, and erasing during the process of producing copies from an original document. However, in a two cycle process there is a combined unit for performing both the developing and the cleaning functions at a single station in a proper timed sequence. The combined unit incorporates the magnetic brush roll with a biasing means to establish the appropriate bias to initiate transfer of toner onto the photoconductor surface during the developing step, and to attract residual toner from the photoconductor surface during the cleaning operation. Since the magnetic brush roll serves the dual role of cleaning and developing, there is no need for a separate cleaning station with a conventional cleaning brush. Nevertheless, there may be an unwanted toner dust cloud that needs to be controlled from this developing and cleaning process.

In order to control the toner dust and beads from unwanted migration, it has been known heretofore to utilize a seal. These seals have typically been of the contacting type, and usually of materials similar to foam or other materials having resilient properties. These contacting seals use a wiping action against a rotating surface to create a seal.

However, these type of contacting seals have a tendency to cause the formation of clinkers. Clinkers are chunks of toner that have been mechanically compressed by a wiper or blade pressing against the toner on the photoconductor. These clinkers, or oversized toner particles, may advance through the development process onto the photoconductor during imaging. Consequently, as the paper comes into contact with the photoconductor for the image transfer, the clinker, due to its size, will stand the paper away from the photoconductor at that locality. As a result, the image on the paper will not develop out evenly, making a less than perfect copy of the original image.

Furthermore, it is known to place these contacting seals between the developer side plate and the magnetic roll to prevent the toner dust and beads from migrating to the bearings of the magnetic roll, or between the developer end plate and the photoconductor such that the foam material presses against the photoconductor forming a seal.

In electrophotographic machines that utilize the above mentioned contact seals, the end plate for the magnetic roll, or the developer side plate, is not in alignment with the end plate that mounts the photoconductor drum. This is due to the inherent critical positional relationship in any electrophotographic development device between the photoconductor and the magnetic roll. For instance, the carrier mix must extend to the edge of the largest image desired for an accurate reproduction of an original in a copy machine. No roll-off in the amount of the carrier mix can be tolerated within the image area. As a consequence, the magnets in the rotating magnetic brush roll must extend some distance beyond the image edge to insure there is no carrier mix roll-off prior to the image edge.

In addition, the coronas have a relationship that must be taken into account. The charge corona must charge all of the image area and must extend somewhat beyond the image area. The preclean corona must be capable of neutralizing the entire image area but cannot be quite as wide as the charge corona. Any other corona of a positive polarity that might be in any particular machine must also be of lesser width than the charge corona. Because of these corona relationships, there must be a photoconductor area extending beyond the image edge of sufficient magnitude to provide a suitable tolerancing of the corona edges. Since the magnetic brush roll must also extend beyond the image edge, the amount of photoconductor beyond the image edge can increase to a significant degree. Adding to that, if a seal for the developer is placed in contact with the photoconductor, still more photoconductor area must be added to the size of the unit.

SUMMARY OF THE INVENTION

It is therefore an object of this invention to control and minimize the toner dust band and bead carryout from migrating axially along the magnetic roll past a non-contact seal that creates a differential air flow, and which is positioned between the magnetic roll and the photoconductor.

It is another object of this invention to return the toner beads that approach the sealing apparatus to the mix in the developer sump.

In accordance with the above stated objects, and to overcome the problems stated in the background art, a noncontact seal is disclosed for use in an electrophotographic development device as in a copier machine. The seal is mounted at one end to the developer housing such that the other end is spatially suspended between the photoconductor and the magnetic roll. The end that is spatially suspended has elongated ridges along the length of the seal which run perpendicular to the axial direction of the magnetic roll. As the photoconductor moves in the direction of the ridges directly above the seal during the copying process, an air flow is developed along the ridges. This air flow is greater than the axial air flow between the photoconductor and the magnetic roll. As a result, a differential air flow is created that inhibits toner dust and bead carryout of the developer carrier mix from axially migrating past the seal in a direction perpendicular to the elongated ridges and towards the common end plate of the photoconductor and the magnetic roll.

In a preferred embodiment, the seal has a tapered corner at one end of the elongated ridges. As the toner beads are swept along the elongated ridges under the influence of the differential air flow, the toner beads will advance towards the tapered corner and fall back into the developer mix below.

This seal of this invention is positioned between the photoconductor and the magnetic brush roll directly under an area which can be used for tolerancing the coronas. In that manner, the width of the photoconductor is reduced, and both the magnetic brush roll and the photoconductor can be journaled in a common end plate. In addition, since the overall width of the photoconductor is reduced, there is a corresponding monetary savings since the photoconductor is an expensive supply item. Furthermore, the overall width of a copier machine utilizing the electrophotographic process may be reduced.

DESCRIPTION OF THE PREFERRED EMBODIMENT

Figure 1:
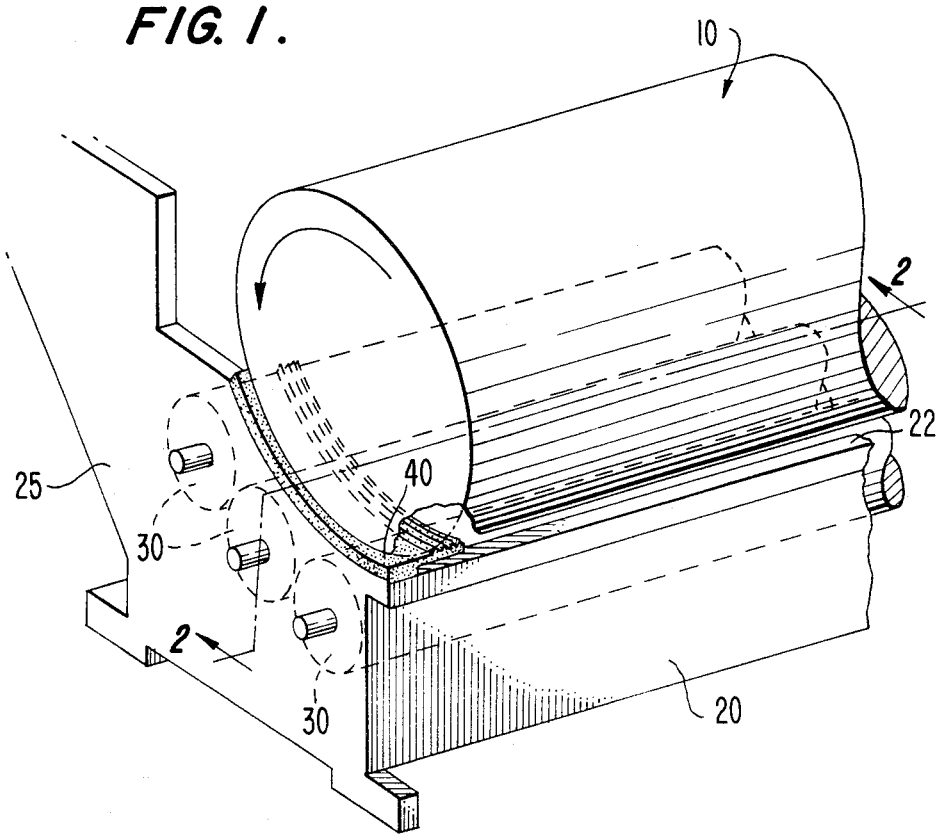
FIG. 1 is an isometric view showing the magnetic brush development device having a developer housing, magnetic roll, and photoconductor drum with the sealing apparatus.

In FIG. 1, the components of a electrophotographic process that are known heretofore to the art are shown as the photoconductor drum 10, the developer 20, the developer side plate 25, and the magnetic roll 30. The sealing apparatus 40 of this claimed invention is shown attached to the developer side plate 25, and extended out between the photoconductor drum 10 and the magnetic roll 30.

As is evident in the known art, electrophotographic processes have a variety of configurations, and not all are representative of the process as indicated in FIG. 1. The sealing apparatus of this invention would be applicable in any electrophotographic process, regardless of configuration. For example, in the process as illustrated in FIG. 1, there are a plurality of magnetic rolls. This sealing apparatus would be just as effective in a development device having only one magnetic roll. Furthermore, the development device as illustrated in FIG. 1 has a photoconductor drum that rotates, thus moving the photoconductor past the magnetic roll during image transfer. Again, this sealing apparatus would be just as effective in a development device having a photoconductor belt which conveys the photoconductor past the magnetic roll during image transfer.

Figure 2:
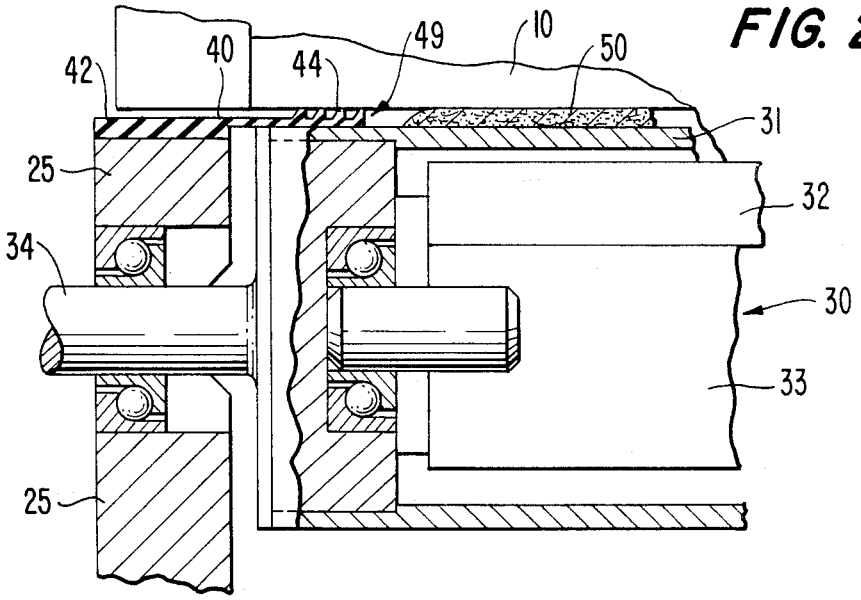
FIG. 2 is a cross-sectional view showing the relationship between the sealing apparatus and the magnetic brush development device as taken from viewing line 2—2 in FIG. 1.

The positioning of the sealing apparatus 40, of this invention, in relation to the components of a electrophotographic process is further shown in FIG. 2, taken along the viewing line 2—2 of FIG. 1. The proximate end 42 of the sealing apparatus 40 is mounted to the developer side plate 25. The elongated ridges 44 of the sealing apparatus 40 are suspended between the photoconductor drum 10 and the magnetic roll 30, which in this illustration includes a mag roll endcap 34, the mag roll shell 31, the magnet 32, and the mag core 33.

In order to maximize the effectiveness of this seal, the ridges 44 of the sealing apparatus 40 preferably do not extend into the region over the magnet 32 of the magnetic roll 30. The seal becomes less effective if the ridges are positioned over the magnet since the toner and toner beads are being controlled by the forces of the magnetic instead of the differential air flow. Furthermore, the migrating toner dust cloud would form on the other side of the ridges, past the area that creates the effective seal. Although any dimension could be used, the seal is most effective when the distal end 49 of the sealing apparatus 40 is between 0 and 15 mm from the end of the magnet 32.

Figure 3:
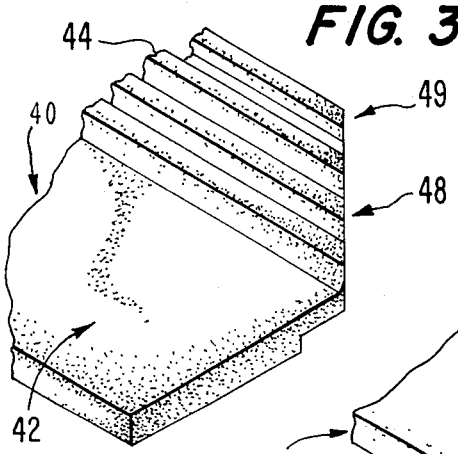
FIG. 3 is an isometric view of the sealing apparatus showing the elongated ridges and the tapered corner of a preferred embodiment.
Figure 4:
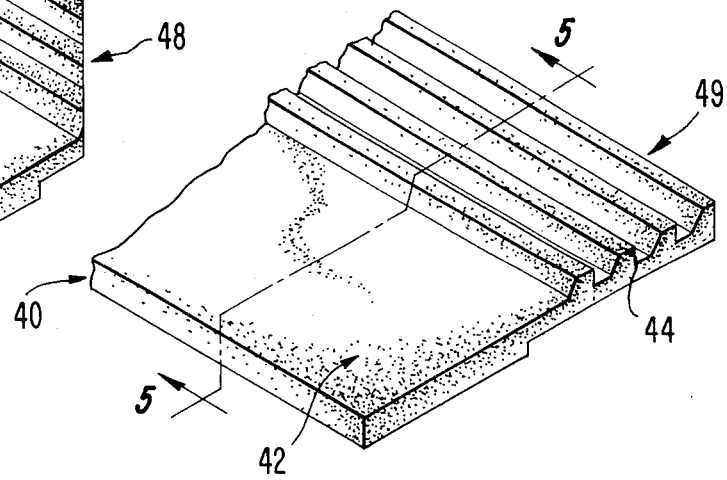
FIG. 4 is an isometric view of the sealing apparatus showing the elongated ridges without the tapered corner.

FIG. 3 is an isometric view of the sealing apparatus showing the elongated ridges 44, the distal end 49, and the tapered corner 48. The tapered corner 48 is a preferred embodiment which allows the toner beads that have become trapped by the sealing apparatus 40 and swept along the elongated ridges 44 to be recycled to the developer sump. The toner beads fall into the developer sump at the tapered corner. Although the tapered corner 48 is a preferred embodiment, the sealing apparatus is effective in preventing axial migration of toner dust and beads without it. FIG. 4 illustrates the sealing apparatus without the tapered corner 48.

FIG. 3 and FIG. 4 also show the proximate end 42 of the sealing apparatus 40 which is mounted to the developer side plate 25 (FIG. 1) so as to spatially suspend in a cantilevered fashion the elongated ridges 44 between the photoconductor drum 10 and the magnetic roll 30.

Figure 5:
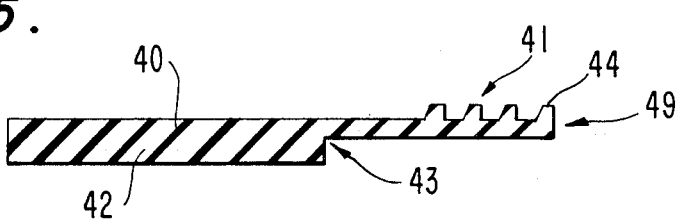
FIG. 5 is a cross-sectional view of the sealing apparatus taken along line 5—5 of FIG. 4 showing a cross-sectional view of the ridges.

As shown in FIG. 5, there is a stepped edge 43 along the underside of the sealing apparatus 40 between the proximate end 42 and the underside of the elongated ridges 44. This stepped edge aids in spatially suspending the elongated ridges 44 in a cantilevered fashion as the proximate end 42 is mounted to the developer side plate.

FIG. 5 shows a cross-sectional view of the sealing apparatus 40 taken along the viewing line 5—5 in FIG. 4. Although in this invention there are four parallel elongated ridges, any number of ridges would work. However, the effectiveness of the sealing apparatus in preventing the axial migration of toner dust and beads could vary upon the number of elongated ridges selected. In addition, the ridges would not have to be exactly parallel to each other or to the edge of the sealing apparatus, although they are in a preferred embodiment. Again, the effectiveness of the sealing apparatus would be affected by these variations.

Furthermore, the ridges may be any height and width. However, in the preferred embodiment of this invention, the ridges are 0.3 mm to 0.5 mm in height and spaced 2 mm apart. Preferably, the ridges are of such a dimension to allow a bead of a known diameter in the carrier mix 50 to travel between the ridges 44 during the operation of the sealing apparatus 40.

DESCRIPTION OF THE OPERATION

Figure 6:
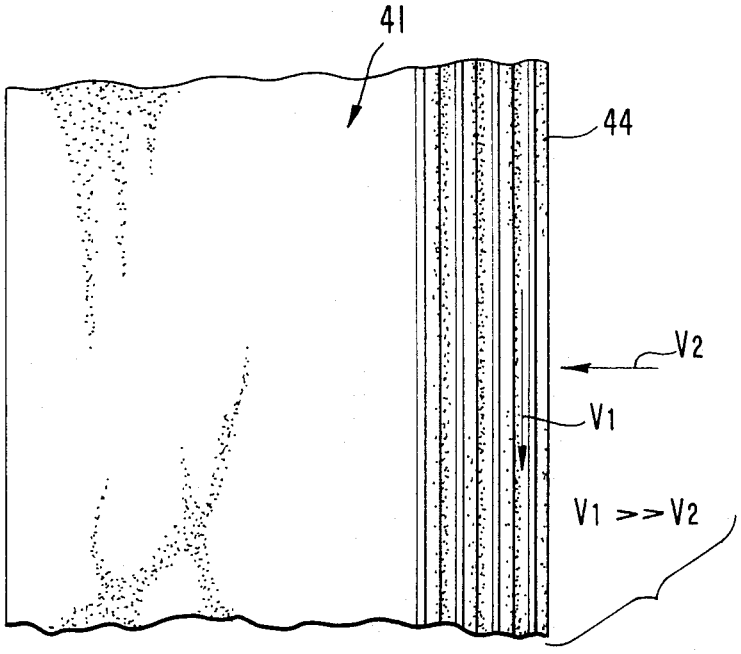
FIG. 6 is a top partial view of the sealing apparatus showing the air flow differential created by the elongated ridges.

In FIG. 1, as the photoconductor drum 10 rotates in the direction of the arrow, a laminar air flow is created over the sealing apparatus 40 in the same direction as the rotation of the photoconductor drum. This direction of air flow is also indicated as V1 in FIG. 6. As further indicated in FIG. 6, this air flow V1 is much greater than the air flow V2 between the photoconductor drum surface and the magnetic roll surface. The air flow V2 flows in a direction parallel to the axes of the photoconductor drum and magnetic roll, and essentially perpendicular to the direction of air flow V1.

The difference in magnitude and direction between the air flow V1 and air flow V2 is referred to as the differential air flow. The rotating drum creates this differential air flow due to the construction of the elongated ridges 44 along the length of the sealing apparatus 40.

As the air-borne toner and beads, which are part of the carrier mix 50, approach the sealing apparatus 40 under the influence of air flow V2, the laminar air flow V1 along the ridges 44 of the sealing apparatus 40, prevents the toner and beads from continuing in the direction of air flow V2, and in the axial direction of the magnetic roll 20 and the photoconductor drum 10. Thereby, toner and bead carryout is controlled by preventing the toner and beads from advancing past the sealing apparatus 40.

In a preferred embodiment, the sealing apparatus is made out of a material that has enough rigidity and stability to spatially suspend the elongated ridges 44 in a cantilevered fashion from the proximate end 42 of the sealing apparatus 40. This seal must be rigid enough to have one end mounted to the developer side plate while the other end extends toward the magnet in the magnetic roll. In addition, the seal must be thin enough to fit into the space between the photoconductor and the magnetic roll, while still maintaining this rigidity. The distance between the photoconductor and the magnetic roll in a typical electrophotographic device is about 1–2 mm. Varying the thickness, width and length of the sealing apparatus within the functional limitations and space restrictions of the sealing apparatus in this development device, will also affect the choice of material to achieve this stability and rigidity.

An example of a material that would meet the above criteria is urethane. In addition, urethane has high wear properties. This is advantageous if the sealing apparatus of this invention ever happens to contact the rotating photoconductor drum. The material would wear at the point of contact until there would no longer be an interference between the photoconductor and the seal. The ease of which the sealing apparatus will wear will also be a function of the width of the ridges, which would most likely be the friction surface in contact with the rotating photoconductor drum. For this reason, the cross-sectional area of the top of the ridges should be minimized so as to minimize the drag on the photoconductor drum, and to increase the rate of wear, in case there happens to be initial contact of the sealing apparatus to the photoconductor drum. Once a minimum amount of wear occurs, the sealing apparatus will again be non-contacting.

However, since urethane has high processing costs associated with its manufacture, neoprene may be a more desirable material to use. Although neoprene has lower wear properties than materials like urethane, this may not be such a critical factor since the seal is non-contacting.

Nevertheless, there are other materials that will be just as effective as the ones specifically mentioned above. While cost and wear are factors to be considered, the main requirement is that the material be rigid enough to spatially suspend the elongated ridges in a cantilevered fashion while being thin enough to allow the seal to be positioned within the small space between the photoconductor and the magnetic roll.

In addition to being positioned within the space between the photoconductor and magnetic roll, the seal of this invention is 0 to 1.5 mm from the surface of the photoconductor in a preferred embodiment. Although other distances may be utilized, this distance was found to be the most effective in preventing the axial migration of toner dust and toner beads.

The sealing apparatus that has been particularly described, is ideally suited for sealing against air-borne toner and bead carryout in a magnetic brush development device that has the end of the magnets in the magnetic roll extending past the image edge of the photoconductor, and the end of the magnetic roll extending past the photoconductor drum, while having the photoconductor drum and the mag roll journaled into the same end plate.

Although this invention has been particularly shown and described with references to the preferred embodiments thereof, it will be recognized that other changes in form may be made without departing from the spirit and scope of this invention.

We claim:

1. A sealing apparatus in an electrophotographic development device comprising:

a developer housing having a magnetic roll rotatably mounted about its axis above a developer sump containing a carrier mix having toner and toner beads;

a photoconductor movable in close proximity to said magnetic roll;

a seal positioned between said magnetic roll and said photoconductor;

means for effectuating a differential air flow above said seal and below said moving photoconductor said differential air flow inhibiting the toner dust and bead carryout of the carrier mix from axially migrating along said magnetic roll past said seal.

2. A sealing apparatus as in claim 1 wherein said seal is positioned between said magnetic roll and said photoconductor 0 to 1.5 mm from the surface of the photoconductor.

3. A sealing apparatus as in claim 1 wherein the seal is positioned between said magnetic roll and said photoconductor drum at a distance away from the ends of the magnet in said magnetic roll.

4. A sealing apparatus as in claim 1 wherein said seal is made of a material rigid enough to spatially suspend the seal in a cantilevered fashion between the photoconductor and the magnetic roll.

5. A sealing apparatus as in claim 1 wherein said seal is made of a high wear material that is rigid enough to spatially suspend the seal in a cantilevered fashion between the photoconductor and the magnetic roll.

6. A sealing apparatus as in claim 1 wherein said means for effectuating a differential air flow above said seal and below said moving photoconductor comprises a plurality of parallel elongated ridges extending the length of said seal.

7. A sealing apparatus in an electrophotographic development device comprising:

a developer housing having a magnetic roll rotatably mounted about its axis above a developer sump containing a carrier mix having toner and toner beads;

a photoconductor movable in close proximity to said magnetic roll;

a plurality of elongated parallel ridges extending the length of said seal and spatially suspending between said magnetic roll and said photoconductor for effectuating a differential air flow below said moving photoconductor, said differential air flow inhibiting the toner dust and bead carryout of the carrier mix from axially migrating along said magnetic roll past said seal; and a proximate end of said seal mounted to said developer housing to effectuate the cantilevering of said seal thereby spatially suspending the elongated ridges between said magnetic roll and said photoconductor.

8. A sealing apparatus in an electrophotographic development device comprising:

a developer housing having a magnetic roll rotatably mounted about its axis above a developer sump containing a carrier mix having toner and toner beads;

a photoconductor movable in close proximity to said magnetic roll;

a seal positioned between said magnetic roll and said photoconductor;

a plurality of elongated parallel ridges extending the length of said seal and spatially suspended between said magnetic roll and said photoconductor for effectuating a differential air flow below said moving photoconductor, said differential air flow inhibiting the toner dust and bead carryout of the carrier mix from axially migrating along said magnetic roll past said seal;

a proximate end of said seal mounted to said developer housing to effectuate the cantilevering of said seal thereby spatially suspending the elongated ridges between said magnetic roll and said photoconductor; and a tapered corner at one end of said elongated ridges for returning toner beads to the developer sump.

9. A non contact seal in a device having a moving surface comprising:

a flat member mountable in non contacting proximity to said moving surface wherein the length of said flat member extends along the direction of movement of said moving surface;

a plurality of elongated ridges extending the length of said flat member for effectuating a differential air flow below said moving surface;

said elongated ridges preventing air flow perpendicular to said elongated ridges effectuating a seal across the width of said flat member.

* * * * *